United States Patent [19]

Mellingen

[11] 4,271,612

[45] Jun. 9, 1981

[54] APPARATUS FOR PRODUCING SKI TRACKS FOR A SKI TRAIL

[75] Inventor: Knut O. Mellingen, Namsskogan, Norway

[73] Assignee: Komiv A/S, Namsskogan, Norway

[21] Appl. No.: 119,076

[22] Filed: Feb. 5, 1980

[30] Foreign Application Priority Data

Feb. 16, 1979 [NO] Norway ..... 790530

[51] Int. Cl.[3] ..... E01H 4/00

[52] U.S. Cl. ..... 37/10; 37/52; 172/188; 172/199; 172/387

[58] Field of Search ..... 37/10, 13, 50, 51, 52, 37/53, 47; 172/387, 392, 393, 199, 779, 188, 784; 280/9, 12 M

[56] References Cited

U.S. PATENT DOCUMENTS

| | | | |
|---|---|---|---|
| 286,969 | 10/1883 | Smith | 37/13 |
| 378,307 | 2/1888 | Haines | 37/51 |
| 428,658 | 5/1890 | Week | 37/52 |
| 851,199 | 4/1907 | Doyle | 37/52 |
| 1,445,952 | 2/1923 | Hooper | 37/53 |
| 4,014,116 | 3/1977 | Baechler | 37/10 |
| 4,021,942 | 5/1977 | Purdy | 37/10 |
| 4,056,328 | 11/1977 | Maxey | 37/10 X |
| 4,110,919 | 9/1978 | Henrichon | 37/10 |
| 4,122,614 | 10/1978 | Cheney | 37/10 |

FOREIGN PATENT DOCUMENTS

| | | | |
|---|---|---|---|
| 2604503 | 10/1976 | Fed. Rep. of Germany | 37/13 |
| 2269362 | 1/1976 | France | 37/10 |

*Primary Examiner*—E. H. Eickholt

*Attorney, Agent, or Firm*—Ladas & Parry

[57] ABSTRACT

An apparatus for producing ski tracks for a ski trail, comprising a sliding/planing body with a flat sliding surface which curves upwardly at the forward section of said body, and spaced-apart track-forming members depending downwardly from said sliding surface. The track-forming members each comprising a bottom surface and two parallel side surfaces whose forward portions converge to form a plow portion while the bottom surface extends forward in full width beneath said plow portion and at least to the tip of it. A drag frame pivotally attached to the surface of the sliding/planing body rearward of its forward section. The axis of pivot for the frame running transversely of the direction of advancement for the sliding/planing body. The track-forming members producing a track with strong, compacted walls, without weighing down the apparatus.

3 Claims, 3 Drawing Figures

APPARATUS FOR PRODUCING SKI TRACKS FOR A SKI TRAIL

The present invention relates to an apparatus for producing ski tracks for a ski trail, of the type defined in the preamble of the appurtenant main claim.

An apparatus of this type is shown in Norwegian Pat. No. 136.175. In a utility model of this, the track-forming members can be regarded as sleigh runners disposed beneath a sliding body; when the apparatus is pulled forward over relatively loose snow, the runners will press the snow down, forming ski tracks in their wake. If the snow is so loose that the runners cannot support the apparatus, the sliding body will come into contact with the snow and prevent the runners from sinking deeper. Thus, the sliding body determines the maximum depth of the track and also helps to compact and level out the surface of the snow. If the snow is so hard that the track-forming members or runners cannot penetrate it, the apparatus of this patent can be loaded with weights, which force the track-forming members down into the snow to produce the desired tracks as the apparatus is pulled along.

The above ski track apparatus produces a track merely by pressing the snow downwards; thus, while the tracks so produced will have a relatively hard surface at the bottom of the groove, the side edges of the track have not been compacted in any way. As a result, the side walls of the tracks are easily worn away during use of the trail, and the ski trail becomes broad and ill defined.

To overcome the above disadvantage, it is common practice to pre-condition the trail path by first compacting the snow in order to form a solid foundation, then employing a track-producing apparatus which, instead of compacting the snow, is adapted to cut grooves or tracks, the leading edges of the track-forming members being provided with a lower cutting edge for cutting the bottom of the track and two lateral cutting edges for forming the side walls of the track. The excavated snow is guided up to the edges of the tracks and can optionally be spread out by means of a following spreader board, similar to a moldboard on a plowshare, which pushes the snow to one side or the other of the tracks that have been formed.

The purpose of the present invention is to provide an apparatus for producing ski tracks in which the track-forming members, at the same time as they are cutting the bottom of the track groove, also press the snow that has been excavated to the sides of the track such that the walls of the track become compacted and are thus stronger than they are when the snow has merely been cut away from these side surfaces. A further feature of the invention is that it is not necessary to weigh the apparatus in order to cause the track-forming members to cut down through a relatively hard snow foundation and to remain in this position as the apparatus is advanced. In addition, the apparatus of the invention includes a planer member which levels the path for the ski trail prior to the formation of the track itself.

Figure 1:
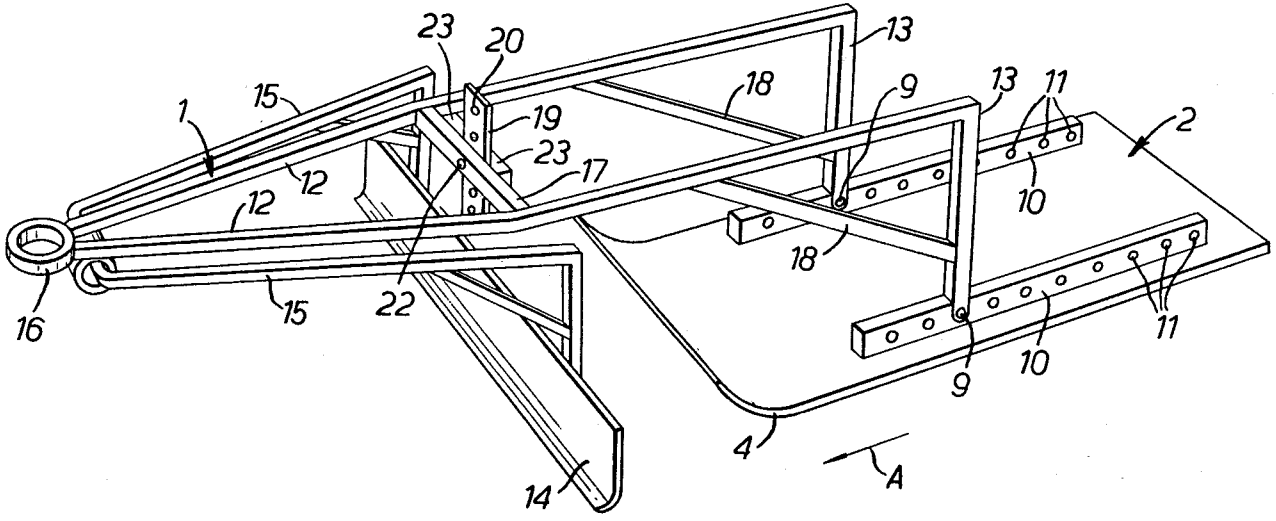
Figure 2:
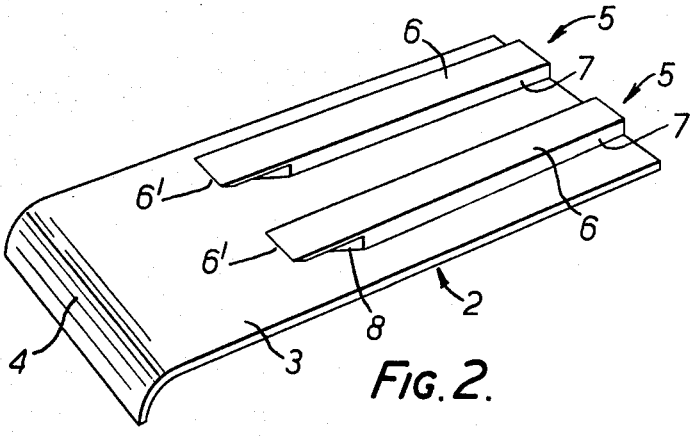
Figure 3:
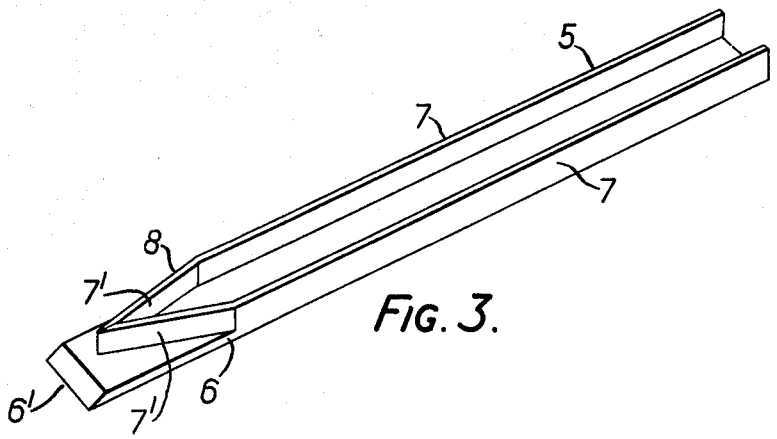

The above advantages are obtained by means of the characterizing features recited in the appurtenant patent claims, and an embodiment of the invention will be described in further detail in the following with reference to the accompanying drawings, where FIG. 1 shows the ski track-producing apparatus, seen in perspective, and FIGS. 2 and 3, respectively, show the sliding surfaces of the sliding- and planning body with its track-forming members, and a top view, in perspective, of a track-forming member.

The ski track-producing apparatus as shown in FIG. 1 consists in general terms of a drag frame 1 with a hitch member 16 at the front for coupling the frame to, for example, a snow scooter, said frame being pivotally attached at 9 to a plate-shaped sliding/planing body 2 having a flat sliding surface 3 which curves upwardly at the forward portion 4 of the body 2. Two parallel track-forming members 5 extend downwardly from the sliding surface 3, the track-forming members 5 being spaced apart at a distance which corresponds to the desired distance between a pair of ski tracks, as shown in FIG. 2.

Each track-forming member 5 comprises a bottom surface 6 and two parallel side surfaces 7 and can be made of a U-steel section, the side surfaces 7 being the flanges of the channel section and the bottom surface 6 being the intermediate body portion. At one end of the channel section, the flanges 7 are separated from the body portion 6 to form two-semi-detached flange sections 7' which are bent together to meet in a point, forming a plow tip 8. The abutting ends of the flange sections 7' can optionally be welded together, and the sections 7' can also be welded to the channel body 6, which extends in its full width forward beneath the plow tip 8 and preferably projects beyond its tip. The channel body 6 preferably terminates in a beveled cutting edge 6', which is formed such that it tends to dig downwards somewhat when the track-forming member is pulled through the snow.

The track-forming members 5 are attached to the sliding surface 3 of the sliding/planing body 2, for example, by welding the side flanges 7 of the track-forming member to the sliding surface 3; alternately, one could bolt the components 5 and 2 together by threading bolts through bores in the bottom plate 6 of the track-forming member, said bolt heads being countersunk in the plate 6, and through bores in the bottom of the sliding/planing body, with nuts being screwed onto the bolts to secure the track-forming members 5 firmly to the body 2. At least two such bolts ought to be provided for securing each track member 5.

The track-forming members 5 extend from the rearward edge of the sliding/planing member 2 and forward toward its front edge 4, but terminate a considerable distance behind said forward edge.

The drag frame 1, which in the embodiment illustrated consists of two horizontal arms 12 connected by a cross strut 17 to stiffen them, terminates in two downwardly-extending vertical legs 13. Fastening holes 9 are provided at the lower ends of the legs 13, which cooperate with a series of holes 11 in two parallel, longitudinal ribs 10 which are provided on the top surface of the sliding/planing body 2. The legs 13 are fastened to the ribs by passing bolts through the fastening holes 9 and through a pair of aligned holes 11 in the ribs 10. To stiffen the arms 12 and legs 13 of the drag frame 1, diagonal struts 18 are provided.

In use, the ski track-producing apparatus is pulled in the direction indicated by the arrow A on FIG. 1 by means of a snow scooter or the like, which is coupled to the drag frame's hitch member 16. The points of attachment for the frame 1 to the sliding/planing body 2 are located a considerable distance rearward of the leading edge 4 of the sliding body 2, and preferably lie rearward of the plow tips 8 of the track-forming members 5. Therefore, the pulling force is applied to the plate-shaped sliding/planing body 2 in back of the leading edge of the track-forming members 5, said leading edge being the cutting edge 6' on the channel bottom 6. As the apparatus is pulled along, the cutting edge 6' will abut against and cut down into the underlying snow foundation while at the same time the sliding/planing body 2 will tip back and forth slightly owing to the application of the pulling force in back of the track cutter 6α, thus producing a tipping moment which reinforces the cutting action of the track cutter 6 into the snow. The apparatus will become balanced, however, as soon as the sliding surface 3 on the sliding/planing body 2 comes into full contact with the underlying snow, its track-forming members 5 then being completely submerged in the snow. In this balanced position, the track cutters 6' on the track-forming members 5 will begin to excavate snow to form the bottom of the groove or track, at the same time as or somewhat before the plow tip 8 divides the mass of excavated snow in the groove in two and presses it to both sides, thus producing edges of compacted snow at the sides of the track, which strengthens the side walls of the ski track so produced. This track will be substatially more resistant to becoming worn down and much more stable in the lateral direction than a track produced simply by plowing into the snow with a cutter member to form a track, and lifting out the excavated snow and pushing it to the side with a following spreader board.

Unlike the prior art ski track-producing apparatus discussed above, the apparatus of the invention does not require the use of additional weights to press the track-cutting members 5 into the underlying snow.

The apparatus of the invention has proved to be well suited to its purpose whether the snow foundation is relatively hard, or powdery, or consists of heavy, wet snow.

In order to regulate the above-discussed tipping motion or the tipping moment, the point of attachment 9 for the drag frame can be adjusted forward or backwards on the ribs 10. The tipping effect can also be influenced by lengthening or shortening the distance between the frame's horizontal portion 12 and its points of attachment 9, i.e., in the embodiment illustrated, by lengthening or shortening the legs 13, which can be done with known per se telescoping devices which will not be described further here.

For leveling and planing the ski trail path prior to making the tracks, a planing board 14 can be arranged on the drag frame 1, the height of the board 14 preferably being adjustable so that it can be set at an appropriate height above the ground, depending on the characteristics of the snow. The planing board 14 will have a leveling effect on the longitudinal section of the ski track, flattening out small bumps or hills and even snowbanks when the trail crosses a plowed road, the snow being pushed forward into the hollow or recess at the foot of the hill or snowbank, after which the sliding/planing body 2 with the track-forming members 5 will press down and smooth the surface of the snow as it simultaneously produces the ski track.

In the embodiment illustrated in FIG. 1, the planing board 14 is suspended from a separate drag frame 15 which is pivotally attached to the forward portion of the frame 1 at the hitch member 16. The planing board 14 can thus pivot freely up and down if desired. However, an upwardly extending arm 19 is provided on the planing board, having a plurality of holes 20 which can be brought into engagement with a bolt (not shown) which passes through a hole 22 in the cross strut 17 between the arms 12 of the frame 1. For lateral stabilization of the planing board 14, guides 23 are provided on the cross strut 17 on either side of the arm 19 such that the arm can be moved up and down between the guide members.

The ski-track-producing apparatus of the present invention can be made in a number of different ways without departing from the scope of protection defined in the appurtenant patent claims.

Thus, the frame 1 might be formed as a simple rod, pivotally attached to a central rib 10 on the sliding/-planing body 2, which rod could be supported in the lateral direction by means of a vertical guide at the forward section 4 of the sliding/planing body 2. The sliding/planing body 2 can have any desired shape as long as it has a flat sliding surface 3 and an upwardly curved section 4 which permits the slide to be pulled forward over the snow without cutting through the surface and becoming struck.

Having described my invention, I claim:

1. An apparatus for producing ski tracks for a ski trail, comprising a sliding/planing body with a flat sliding surface which curves upwardly at the forward section of said body, and spaced-apart track-forming members depending downwardly from said sliding surface, the track-forming members each comprising a bottom surface and two parallel side surfaces whose forward portions converge to form a plow portion while the bottom surface extends forward beneath said plow portion, and a drag frame pivotally attached by means of attachment members to the surface of the sliding/planing body at a distance rearward of its forward section, the axis of pivot for the frame running transversely of the direction of advancement for the sliding/planing body, characterized in that the bottom surface extends forward in full width to the tip of the plow part.

2. A ski track-forming apparatus according to claim 1, characterized in that the bottom surface extends beyond the tip of the plow portion.

3. A ski track-forming apparatus according to any one of the preceding claims, characterized in that the forward edge of the bottom plates is formed as a beveled cutting edge.

* * * * *